US008049684B2

(12) United States Patent
Kim

(10) Patent No.: US 8,049,684 B2
(45) Date of Patent: Nov. 1, 2011

(54) ORGANIC ELECTROLUMINESCENT DISPLAY DEVICE

(75) Inventor: Yang-Wan Kim, Suwon-si (KR)

(73) Assignee: Samsung Mobile Display Co., Ltd, Yongin (KR)

( * ) Notice: Subject to any disclaimer, the term of this patent is extended or adjusted under 35 U.S.C. 154(b) by 892 days.

(21) Appl. No.: 11/521,849

(22) Filed: Sep. 14, 2006

(65) Prior Publication Data

US 2007/0118781 A1 May 24, 2007

(30) Foreign Application Priority Data

Sep. 15, 2005 (KR) ..... 10-2005-0086370

(51) Int. Cl.
*G09G 3/30* (2006.01)

(52) U.S. Cl. ..... 345/76; 315/169.3

(58) Field of Classification Search ..... 345/76–83, 345/36, 45, 55, 204–215, 690–699; 340/825; 315/169.1–169.4
See application file for complete search history.

(56) References Cited

U.S. PATENT DOCUMENTS

| | | | | |
|---|---|---|---|---|
| 5,021,774 | A | 6/1991 | Ohwada et al. | |
| 5,402,141 | A | 3/1995 | Haim et al. | |
| 6,046,890 | A | 4/2000 | Yamada et al. | |
| 6,229,506 | B1 | 5/2001 | Dawson et al. | |
| 6,847,172 | B2 * | 1/2005 | Suzuki | 315/169.3 |
| 6,864,637 | B2 | 3/2005 | Park et al. | |
| 6,885,029 | B2 | 4/2005 | Miyazawa | |
| 6,919,871 | B2 * | 7/2005 | Kwon | 345/92 |
| 2001/0019327 | A1 | 9/2001 | Kim et al. | |
| 2002/0196389 | A1 | 12/2002 | Koyama | |
| 2003/0043132 | A1 | 3/2003 | Nakamura | |
| 2003/0085885 | A1 | 5/2003 | Nakayoshi et al. | |
| 2003/0098657 | A1 | 5/2003 | Suzuki | |
| 2003/0179164 | A1 * | 9/2003 | Shin et al. | 345/76 |
| 2003/0227262 | A1 * | 12/2003 | Kwon | 315/169.3 |
| 2004/0080474 | A1 | 4/2004 | Kimura | |

(Continued)

FOREIGN PATENT DOCUMENTS

CN 1312535 A 9/2001

(Continued)

OTHER PUBLICATIONS

U.S. Office action dated Apr. 15, 2008, for related U.S. Appl. No. 11/107,450, indicating relevance of references in this IDS.

(Continued)

*Primary Examiner* — Alexander Eisen
*Assistant Examiner* — Patrick F Marinelli
(74) *Attorney, Agent, or Firm* — Christie, Parker & Hale, LLP

(57) ABSTRACT

An organic electroluminescent display device employing a demultiplexer to reduce the number of output lines of a data driver. The display device uses the demultiplexer to store a data voltage in a data line, and supplies the stored data voltage to a pixel when a scan signal is applied, thereby displaying an image. Here, the data voltage supplied to the pixel is lowered because an electric charge is shared between a data line capacitor and a storage capacitor in the pixel. To compensate for the lowered data voltage, an auxiliary capacitor is provided for generating a compensation voltage. Here, the auxiliary capacitor increases the data voltage according to a level change of the scan signal. Therefore, a decrease in level of the voltage applied to the pixel is reduced or prevented so that DC/DC efficiency is enhanced without lowering a power supply voltage and a reference voltage.

20 Claims, 6 Drawing Sheets

U.S. PATENT DOCUMENTS

| | | | | |
|---|---|---|---|---|
| 2004/0090400 | A1 | 5/2004 | Yoo | |
| 2004/0104870 | A1 | 6/2004 | Mametsuka | |
| 2004/0145547 | A1* | 7/2004 | Oh | 345/76 |
| 2004/0239599 | A1 | 12/2004 | Koyama | |
| 2005/0024297 | A1* | 2/2005 | Shin | 345/76 |
| 2005/0068271 | A1 | 3/2005 | Lo | |
| 2005/0093464 | A1 | 5/2005 | Shin et al. | |
| 2005/0156829 | A1 | 7/2005 | Choi et al. | |
| 2005/0280614 | A1* | 12/2005 | Goh | 345/76 |

FOREIGN PATENT DOCUMENTS

| | | | |
|---|---|---|---|
| CN | 1490779 | A | 4/2004 |
| CN | 1577453 | A | 2/2005 |
| EP | 1 496 495 | A2 | 1/2005 |
| EP | 1496495 | A2 * | 1/2005 |
| EP | 1 635 324 | A1 | 3/2006 |
| EP | 1 755 104 | A2 | 2/2007 |
| JP | 10-254412 | | 9/1998 |
| JP | 2001-147659 | | 5/2001 |
| JP | 2002-328643 | | 11/2002 |
| JP | 2003-140612 | | 5/2003 |
| JP | 2003-150082 | | 5/2003 |
| JP | 2004-12634 | | 1/2004 |
| JP | 2004-12897 | | 1/2004 |
| JP | 2004-029791 | | 1/2004 |
| JP | 2004-093682 | | 3/2004 |
| JP | 2004-117921 | | 4/2004 |
| JP | 2004-334179 | | 11/2004 |
| JP | 2005-031630 | | 2/2005 |
| JP | 2005-134874 | | 5/2005 |
| KR | 2002-0090574 | | 12/2002 |
| KR | 2003-0095215 | | 12/2003 |
| KR | 10-2005-0041088 | | 5/2005 |
| WO | WO 01/06484 | A1 | 1/2001 |

OTHER PUBLICATIONS

China Office action dated Aug. 8, 2008, for corresponding China application 200610127463X, with English translation indicating relevance of listed reference in this IDS.

Patent Abstracts of Japan, Publication No. 2003-140612, dated May 16, 2003, in the name of Hitoshi Tsuge.

Patent Abstracts of Japan, Publication No. 2004-029791, dated Jan. 29, 2004, in the name of Oh-Kyong Kwon.

Patent Abstracts of Japan, Publication No. 2005-134874, dated May 26, 2005, in the name of Dong-Yong Shin.

European Search Report dated Feb. 28, 2007, for EP 06120752.8, in the name of Samsung SDI Co., Ltd.

Patent Abstracts of Japan, Publication No. 10-254412, dated Sep. 25, 1998, in the name of Mitsuharu Nakazawa et al.

Patent Abstracts of Japan, Publication No. 2001-147659, dated May 29, 2001, in the name of Machio Yamagishi et al.

Patent Abstracts of Japan, Publication No. 2002-328643, dated Nov. 15, 2002, in the name of Munehiro Asami et al.

Korean Patent Abstracts, Publication No. 1020060095215 A, dated Dec. 18, 2003, in the name of O Gyeong Kwon.

Choi, et al., "A Self-compensated Voltage Programming Pixel Structure for Active-Matrix Organic Light Emitting Diodes", XP008057381, pp. 535-538.

European Search Report dated Dec. 6, 2010, for corresponding European Patent application 06120752.8, noting listed reference in this IDS.

* cited by examiner

ORGANIC ELECTROLUMINESCENT DISPLAY DEVICE

CROSS-REFERENCE TO RELATED APPLICATION

This application claims priority to and the benefit of Korean Patent Application No. 10-2005-0086370, filed Sep. 15, 2005, the entire content of which is incorporated herein by reference.

BACKGROUND OF THE INVENTION

1. Field of the Invention

The present invention relates to an organic electroluminescent display device, and more particularly, to an organic electroluminescent display device that employs a demultiplexer to reduce the number of output lines of a data driver and display an image with uniform brightness.

2. Description of the Related Art

An organic light emitting diode (OLED) of an organic electroluminescent display device is a self-emissive element that emits light by recombination of electrons supplied from a cathode and holes supplied from an anode. The organic electroluminescent display device employs a thin film transistor (TFT) formed in each pixel to supply a driving current corresponding to a data signal to the organic light emitting diode (OLED), thereby causing the organic light emitting diode (OLED) to emit light and display an image (or a predetermined image).

FIG. 1 is a block diagram of a conventional organic electroluminescent display device.

Referring to FIG. 1, the organic electroluminescent display device includes a display region 10, a scan driver 20, a data driver 30, and a timing controller 40.

The display region 10 includes a plurality of pixels P11-Pnm formed at regions where a plurality of scan lines S1-Sn, a plurality of emission control lines E1-En, and a plurality of data lines D1-Dm cross. Each of the pixels P11-Pnm receives a first power supply voltage Vdd and a second power supply voltage Vss from one or more external power supplies, and emits light corresponding to a data signal transmitted from the data lines D1-Dm, thereby displaying an image. Further, an emission time of each of the pixels P11-Pnm is controlled according to one or more emission control signals transmitted through the emission control lines E1-En.

The scan driver 20 generates scan signals in response to a scan control signal Sg from the timing controller 40, and sequentially supplies the generated scan signals to the scan lines S1-Sn to select the pixels P11-Pnm. Further, the scan driver 20 generates emission control signals in response to the scan control signal Sg, and sequentially supplies the generated emission control signals to the emission control lines E1-En to control the emission.

The data driver 30 receives R, G, and B data from the timing controller 40, generates one or more data signals in response to a data control signal Sd, and supplies the generated data signals to the data lines D1-Dm. Here, the data driver 30 supplies the data signals to the data lines D1-Dm for one horizontal line per one horizontal period.

The timing controller 40 generates the data control signal Sd in accordance with video data and the scan control signal Sg in accordance with horizontal and vertical synchronization signals Hsync and Vsync. The video data and/or the horizontal and vertical synchronization signals Hsync and Vsync are supplied from an external graphic controller (not shown). The data control signal Sd generated from the timing controller 40 is supplied to the data driver 30, and the scan control signal Sg is supplied from the timing controller 40 to the scan driver 20.

In the conventional organic electroluminescent display device with this configuration, the pixels P11-Pnm are disposed in the regions around where the scan lines S1-Sn, the emission control lines, E1-En, and the data lines D1-Dm cross (or intersect). Here, the data driver 30 includes m output lines so as to supply the data signals to m data lines D1-Dm, respectively. That is, the data driver 30 in the conventional organic electroluminescent display device should have the same number of output lines as there are data lines D1-Dm. Therefore, the data driver 30 has to include a plurality of data integrated circuits (ICs) to form m output lines, thereby increasing production costs. Particularly, as the resolution and the size of the display region 10 increase, the data ICs of the data driver 30 also increase. Therefore, production cost increases correspondingly.

SUMMARY OF THE INVENTION

An aspect of the present invention provides an organic electroluminescent display device that employs a demultiplexer to reduce the number of output lines of a data driver and display an image with uniform brightness.

According to an embodiment of the present invention, an organic electroluminescent display device includes: a display region having a plurality of pixels formed at regions where a plurality of scan lines and a plurality of data lines cross to display an image thereon; a scan driver for supplying scan signals to the plurality of scan lines and for selecting the plurality of pixels; a plurality of demultiplexers for sequentially supplying data voltages to the plurality of data lines; and a data driver for supplying the data voltages to a plurality of output lines connected to the respective demultiplexers, wherein each of the pixels includes: a storage capacitor for storing at least one of the data voltages from at least one of the data lines in response to a first one of the scan signals; and an auxiliary capacitor connected between the storage capacitor and the at least one of the scan lines and for generating a compensation voltage to increase the at least one of the data voltages according to a level change of the first one of the scan signals.

According to another embodiment of the present invention, an organic electroluminescent display device includes a plurality of pixels formed at regions where a plurality of scan lines and a plurality of data lines cross. Each of the pixels includes: a pixel driving circuit comprising a storage capacitor for storing a data voltage from at least one of the data lines in response to a scan signal of at least one of the scan lines and an auxiliary capacitor connected between the storage capacitor and the at least one of the scan lines to generate a compensation voltage for increasing the data voltage according to a level change of the scan signal, and being adapted to output a driving current; and an organic light emitting diode connected to the pixel driving circuit to emit light with a brightness according to an amount of the driving current.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
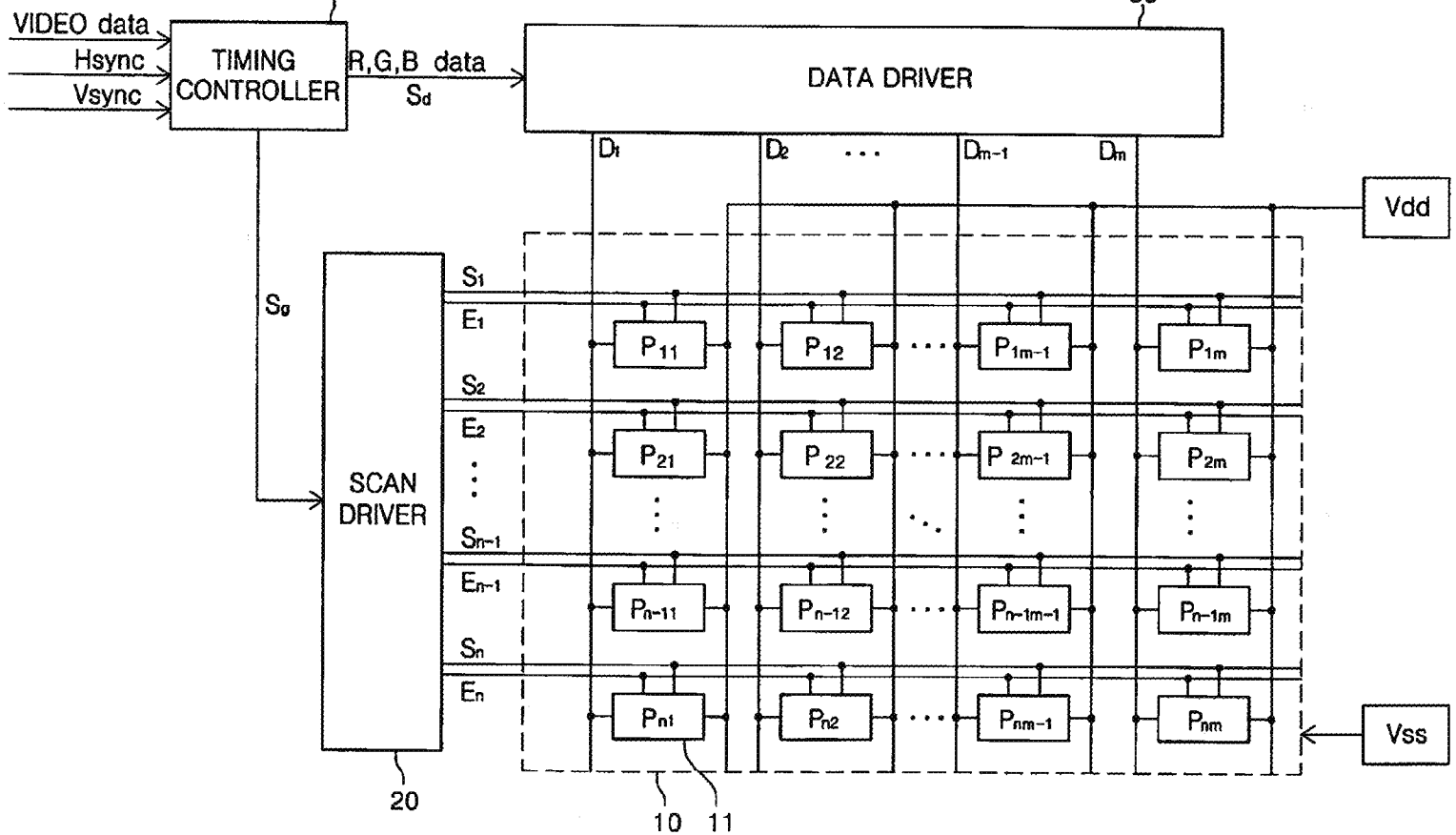
FIG. 1 (PRIOR ART)
FIG. 1 is a block diagram of a conventional organic electroluminescent display device.
Figure 2:
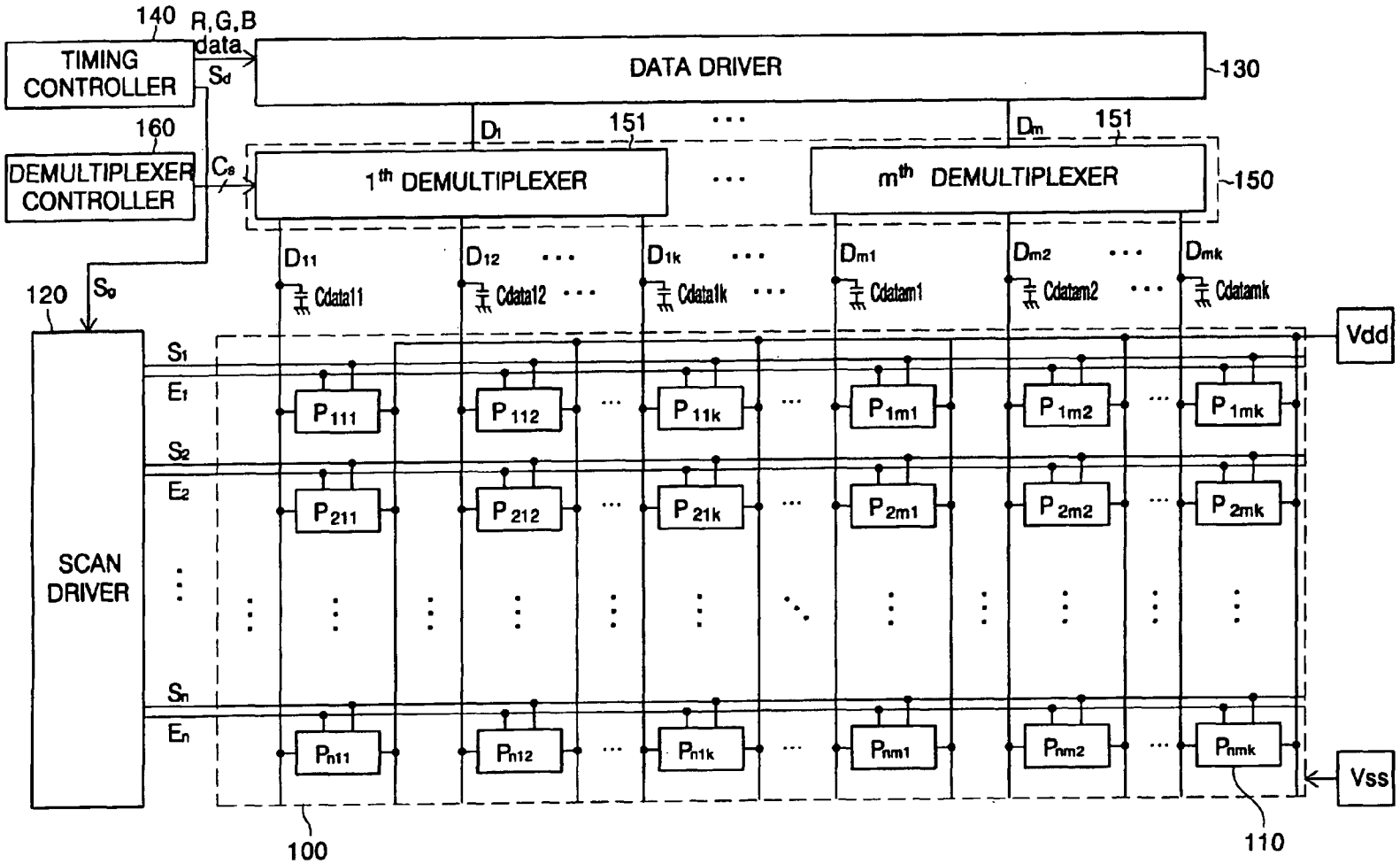
FIG. 2 is a block diagram of an organic electroluminescent display device according to an embodiment of the present invention.

FIG. 2 is a block diagram of an organic electroluminescent display device according to an embodiment of the present invention.

Referring to FIG. 2, the organic electroluminescent display device according to an embodiment of the present invention includes a display region 100, a scan driver 120, a data driver 130, a timing controller 140, a demultiplexing unit 150, and a demultiplexer controller 160.

The display region 100 includes a plurality of pixels P111-Pnmk disposed at regions defined by a plurality of scan lines S1-Sn, a plurality of emission control lines E1-En, and a plurality of data lines D11-Dmk.

Each of the pixels P111-Pnmk emits light corresponding to a data signal transmitted from the data lines D11-Dmk. An exemplary pixel 110 among the pixels P111-Pnmk will be described below in more detail.

In the regions of the pixels P111-Pnmk, a plurality of data line capacitors $C_{datra11}$-$C_{datamk}$ are provided corresponding to the respective data lines D11-Dmk to thereby temporarily store the data signals.

For example, in a data programming period, when a data voltage is applied to the $1^{st}$ data line D11 so as to make the $1^{st}$ pixel P111 emit light, the $1^{st}$ data line capacitor $C_{data11}$ formed in the data line D11 temporarily stores the data voltage. Then, in a scan period, when the $1^{st}$ pixel P111 is selected by the 1st scan signal S1, the data voltage stored in the $1^{st}$ data line capacitor $C_{data11}$ is supplied to the $1^{st}$ pixel P111 so that light is emitted corresponding to the data voltage.

Thus, the data line capacitors $C_{datra11}$-$C_{datamk}$ formed in the respective data lines D11-Dmk temporarily store the data signals supplied to the plurality of data lines D11-Dmk, and supply the stored data voltages to the pixels P111-Pnmk selected by the scan signals. Here, the data line capacitors $C_{datra11}$-$C_{datamk}$ can be realized by parasitic capacitances (or capacitors) equivalently formed by the data lines D11-Dmk, a third electrode, and an insulating layer therebetween. Here, substantially, the capacitance of each of the data line capacitors $C_{datra11}$-$C_{datamk}$ is set to be larger than that of a storage capacitor Cst provided in each of the pixels P111-Pnmk to stably store the data signals.

Figure 7:
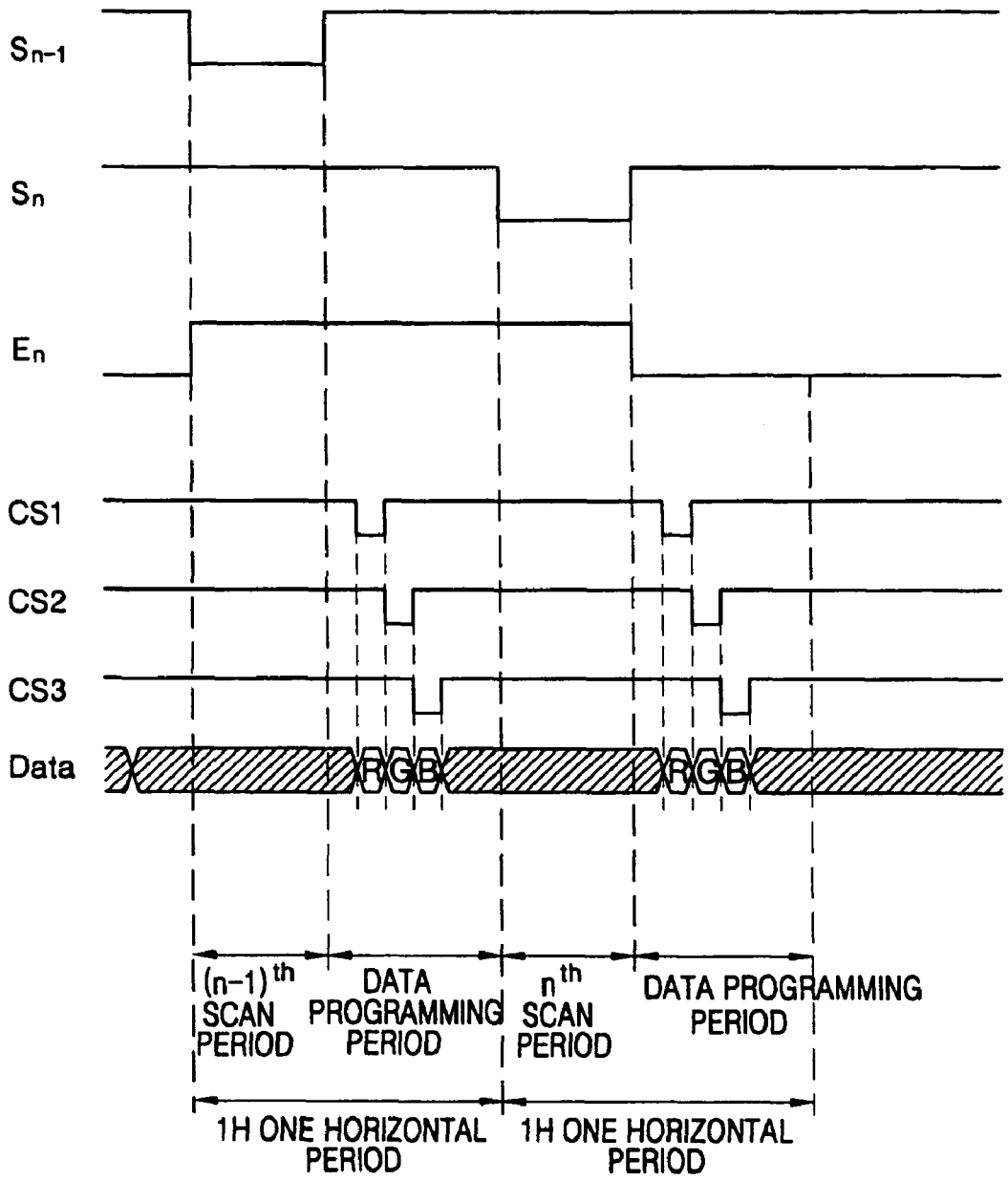
FIG. 7 is a timing diagram for driving a pixel circuit of FIG. 6.

The scan driver 120 generates scan signals in response to a scan control signal Sg supplied from the timing controller 140, and sequentially supplies the generated scan signals to the scan lines S1-Sn. Here, as shown in FIG. 7, the scan driver 110 supplies the scan signal only in a partial period (i.e., a scan period) of one horizontal period 1H. In more detail, one horizontal period 1H according to an embodiment of the present invention is divided into a scan period and a data programming period. The scan driver 120 supplies the scan signal to the scan line Sn in the scan period of one horizontal period 1H, and does not supply the scan signal in the data programming period. In addition, the scan driver 120 generates emission control signals in response to the scan control signal Sg, and sequentially supplies the emission control signals to the emission control lines E1-En, thereby controlling the emission.

The data driver 130 receives R, G and B data from the timing controller 140, and sequentially supplies the R, G and B data signals to output lines D1-Dmk in response to data control signals Sd. Here, the data driver 130 sequentially supplies k data signals (e.g., three R, G and B data signals in FIG. 7) to the output lines D1-Dmk connected to respective output terminals thereof, in which k is an integer greater than or equal to 2. In more detail, the data driver 130 sequentially supplies data signals (e.g., R, G and B data) to the corresponding pixels in the data programming period of one horizontal period 1H. Here, the data signals (R, G and B) are supplied only in the data programming period, which does not overlap the scan period for supplying the scan signal.

The timing controller 140 generates the data control signal Sd in accordance with video data and the scan control signal Sg in accordance with horizontal and vertical synchronization signals Hsync and Vsync. The video data and/or the horizontal and vertical synchronization signals Hsync and Vsync are supplied from one or more external graphic controllers (not shown). The data control signal Sd generated from the timing controller 140 is supplied to the data driver 130, and the scan control signal Sg is supplied from the timing controller 140 to the scan driver 120.

The demultiplexing unit 150 includes m demultiplexers 151. In more detail, the demultiplexing unit 150 includes the same number of demultiplexers 151 as the number of output lines D1-Dm connected to the data driver 130, and input terminals of the demultiplexers 151 are connected to the output lines D1-Dm of the data driver 130, respectively. Further, an output terminal of each of the demultiplexers 151, e.g., the output terminal of the 1st demultiplexer 151, is connected to k data lines D11-D1*k*. The $1^{st}$ demultiplexer 151 (hereafter also referred to as the demultiplexer 151) applies k data signals, sequentially supplied in the data programming period, to the k data lines D11-D1*k*. Thus, when the k data signals sequentially supplied to a single output line D1 are sequentially applied to the k data lines D11-D1*k*, the number of output lines that are needed in the data driver 130 can be decreased. For example, assuming that k is 3, the number of output lines provided in the data driver 130 decreases to one third (⅓) of the number of output lines in a conventional data driver. In addition, the number of data ICs provided in the data driver 130 can also be decreased to one third (⅓) of the number of the conventional data driver. Thus, according to an embodiment of the present invention, when the demultiplexer (or 1st demultiplexer) 151 is used to supply the data signals from one output line D1 to the k data lines D11-D1*k*, the production cost of the data ICs can be reduced.

The demultiplexer controller 160 supplies the k control signals to control terminals of the demultiplexer 151 in the data programming period of one horizontal period 1H so that the demultiplexer 151 can individually supply the k data signals of the output line D1 to the k data lines D11-D1*k*. Here, as shown in FIG. 7, the k control signals (e.g., CS1, CS2, and CS3) are sequentially supplied from the demultiplexer controller 160 in the data programming period without overlapping one another. In this embodiment, the demultiplexer controller 160 is provided separately from the timing controller 140 (refer to FIG. 2), but the invention is not limited to such a configuration. Alternatively, the demultiplexer controller 160 may be provided integrally with the timing controller 140.

Figure 3:
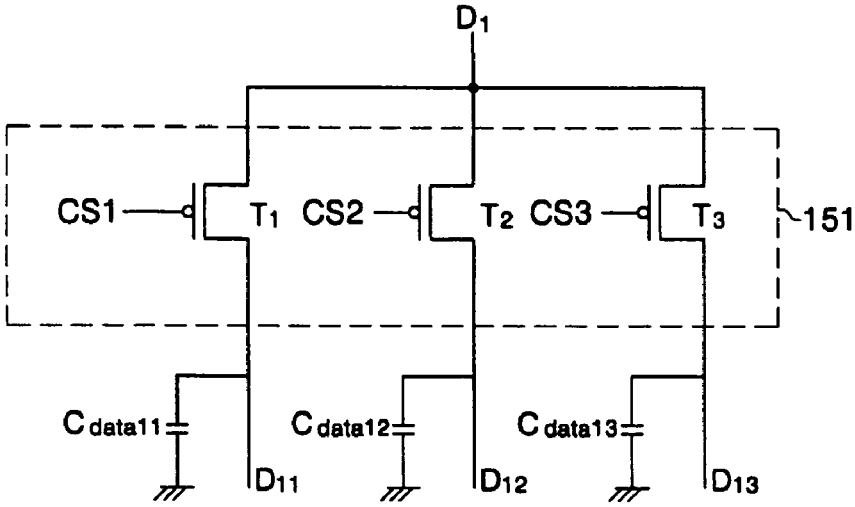
FIG. 3 is a circuit diagram of a demultiplexer of FIG. 2.

FIG. 3 is a circuit diagram of the demultiplexer of FIG. 2. For convenience purposes, in FIG. 3, it is assumed that k is 3, and the data voltages are input in order of red, green and blue. Further, it is assumed that the demultiplexer 151 is connected to the $1^{st}$ output line D1 of the data driver 130.

Referring to FIG. 3, the demultiplexer 151 includes a first switching device T1, a second switching device T2, and a third switching device T3. Here, each of the switching devices T1, T2, and T3 can be formed by a thin film transistor. According to an embodiment of the present invention, the switching devices T1, T2 and T3 are implemented by P-type metal oxide semiconductor field effect transistors (MOSFETs), but the invention is not limited to using MOSFETs. In addition, the invention is not limited to a conductive type of the transistors (i.e., the invention is not limited to a type of major carriers in the channels (or channel type) of the transistors). For example, the switching devices T1, T2 and T3 may be implemented by N-type MOSFETs.

The first switching device T1 is connected between the $1^{st}$ output line D1 and the $1^{st}$ data line D11. The first switching device T1 is turned on when a $1^{st}$ control signal CS1 is supplied from the demultiplexer controller 160, and supplies a red data signal from the $1^{st}$ output line D1 to the $1^{st}$ data line D11. The data signal supplied to the $1^{st}$ data line D11 is stored in the $1^{st}$ data line capacitor $C_{data11}$ in the data programming period shown in FIG. 7.

The second switching device T2 is connected between the $1^{st}$ output line D1 and the $2^{nd}$ data line D12. The second switching device T2 is turned on when a $2^{nd}$ control signal CS2 is supplied from the demultiplexer controller 160, and supplies a green data signal from the $1^{st}$ output line D1 to the $2^{nd}$ data line D12. The data signal supplied to the $2^{nd}$ data line D12 is stored in the $2^{nd}$ data line capacitor $C_{data12}$ in the data programming period shown in FIG. 7.

The third switching device T3 is connected between the $1^{st}$ output line D1 and the $3^{rd}$ data line D13. The third switching device T3 is turned on when a $3^{rd}$ control signal CS3 is supplied from the demultiplexer controller 160, and supplies a blue data signal from the $1^{st}$ output line D1 to the $3^{rd}$ data line D13. The data signal supplied to the $3^{rd}$ data line D13 is stored in the $3^{rd}$ data line capacitor $C_{data13}$ in the data programming period shown in FIG. 7. Such operations of the demultiplexer 151 will be described later in more detail and in association with the structure of the pixel 110.

Figure 4:
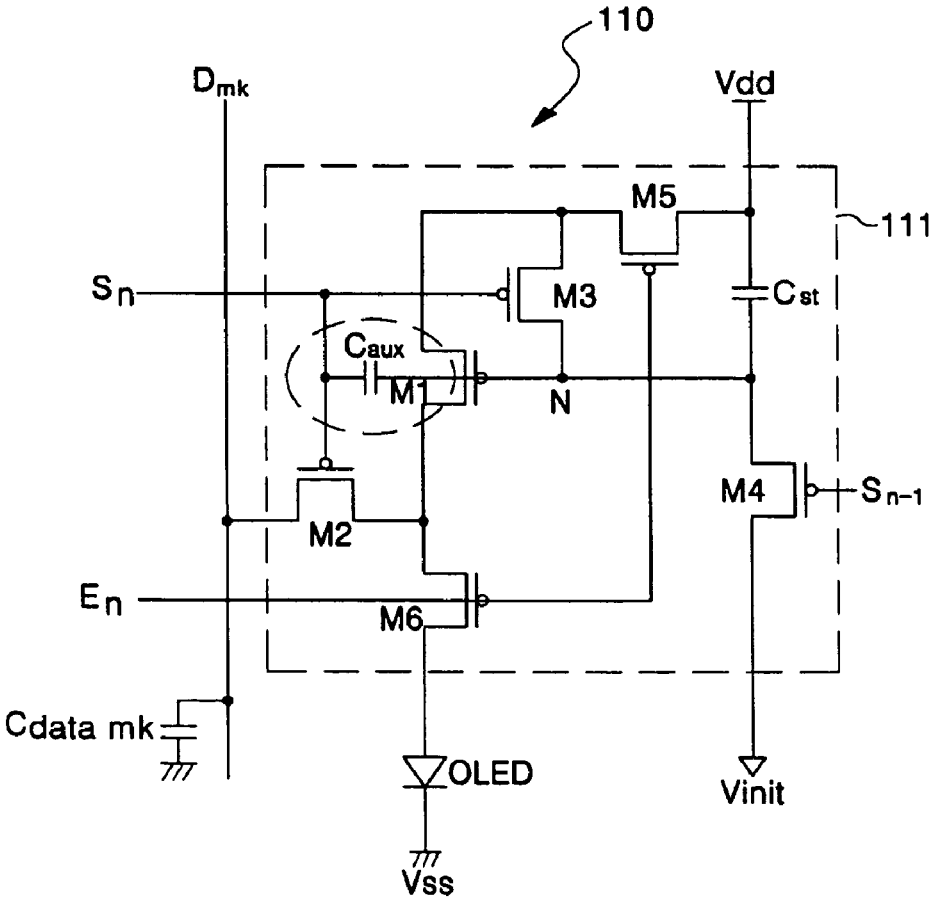
FIG. 4 is a circuit diagram of an exemplary pixel among N×M pixels of FIG. 2.

FIG. 4 is a circuit diagram of an exemplary pixel among N×M pixels of FIG. 2, but the present invention is not limited to the illustrated circuit configuration.

Referring to FIG. 4, the exemplary pixel 110 according to an embodiment of the present invention includes a pixel driving circuit 111 that is connected to an organic light emitting diode OLED, a data line Dmk, previous and current scan lines Sn and Sn−1, an emission control line En, a first power supply voltage line of a first power supply voltage Vdd, and an initialization voltage line Vinit, and generates a driving current to make the organic light emitting diode OLED emit light. The data line Dmk is formed with a data line capacitor $C_{datamk}$ to supply a data voltage to the pixel 110.

The organic light emitting diode OLED has an anode connected to the pixel driving circuit 111, and a cathode connected to a second power supply voltage line of a second power supply voltage Vss. The second power supply voltage Vss is lower in voltage level than the first power supply voltage Vdd. For example, the second power supply voltage Vss may be a ground voltage, a negative voltage, etc. Thus, the organic light emitting diode (OLED) emits light corresponding to the driving current supplied from the pixel driving circuit 111.

The pixel driving circuit 111 has a threshold voltage compensation circuit including a storage capacitor Cst and six transistors M1, M2, M3, M4, M5, and M6. Here, the first transistor M1 is a driving transistor. The third transistor M3 is a threshold voltage compensation transistor for compensating a threshold voltage by connecting the first (or driving) transistor M1 to function like a diode. The fourth transistor M4 is an initialization transistor for initializing the storage capacitor Cst. The sixth transistor M6 is an emission control transistor for controlling emission of the organic light emitting diode OLED. The second and fifth transistors M2 and M5 are first and second switching transistors.

The first switching transistor M2 has a gate electrode connected to the scan line Sn, and a source electrode connected to the data line Dmk. The first switching transistor M2 is turned on by the scan signal transmitted through the current scan line Sn, and applies the data voltage from the data line capacitor $C_{datamk}$.

The driving transistor M1 has a first electrode (e.g., a drain electrode) connected to a drain electrode of the first switching transistor M2, and a gate electrode connected to a node N. A source or drain electrode of the threshold voltage compensation transistor M3, and a first terminal of the storage capacitor Cst are connected in common to the node N.

The threshold voltage compensation transistor M3 is connected between the gate electrode and a second electrode (e.g., a source electrode) of the driving transistor M1, and connects the driving transistor M1 to function like a diode in response to the scan signal transmitted through the current scan line Sn. Thus, the driving transistor M1 operates substantially as a diode according to the scan signal, so that a voltage Vdata−Vth[V] is applied to the node N and used as the gate voltage of the driving transistor M1. Thus, the driving transistor M1 generates the driving current corresponding to a voltage applied to the gate electrode thereof.

The initialization transistor M4 is connected between the initialization voltage line Vinit and the first terminal of the storage capacitor Cst, and discharges an electric charge, which is charged in the storage capacitor Cst in a previous frame, through the initialization voltage line Vinit in response to the scan signal of the previous scan line Sn−1 connected to a gate electrode of the initialization transistor M4. Thus, the initialization transistor M4 initializes the storage capacitor Cst.

The second switching transistor M5 is connected between the first power supply voltage line of the first power supply voltage Vdd and the second (or source) electrode of the driving transistor M1. The second switching transistor M5 is turned on by the emission control signal transmitted through the emission control line En connected to the gate electrode thereof, and supplies the first power supply voltage Vdd to the source electrode of the driving transistor M1.

The emission control transistor M6 is connected between the driving transistor M1 and the organic light emitting diode OLED, and applies the driving current generated by the driving transistor M1 to the organic light emitting diode OLED in response to the emission control signal transmitted through the emission control line En connected to a gate electrode of the emission control transistor M6.

The storage capacitor Cst is connected between the first power supply voltage line Vdd and the gate electrode of the driving transistor M1, and maintains an electric charge corresponding to a voltage difference between the first power supply voltage Vdd and the voltage Vdata−Vth[V] applied to the gate electrode of the driving transistor M1 during one frame.

In FIG. 4, the first through sixth transistors M1 through M6 are PMOSFETs, but the invention is not limited to such a configuration. For example, the invention is not limited to a conductive type of the transistors (i.e., the invention is not limited to a type of major carriers in the channels (or channel type) of the transistors). That is, the first through sixth transistors may be implemented as NMOSFETs for example.

In a pixel with this configuration, the data line capacitor $C_{datamk}$ stores a voltage corresponding to the data signal in the data programming period, and supplies the voltage stored in the data line capacitor $C_{datamk}$ to the pixel in the scan period, thereby supplying the data signal to the pixel. Thus, the voltages stored in the data line capacitors $C_{data11}$-$C_{data1k}$ are supplied to the respective pixels at the same time. That is, because the respective data signals are supplied at the same time, an image can be displayed with uniform brightness.

However, as the data programming period and the scan period are temporally separated in the pixel with this configuration, the data line capacitor $C_{datamk}$ and the storage capacitor Cst of the pixel, which are temporally separated in the data programming period, are temporally connected in the scan period, so that the electric charge corresponding to the data voltage Vdata stored in the data line capacitor $C_{datamk}$ is shared between the data line capacitor $C_{datamk}$ and the storage capacitor Cst. Thus, the gate voltage $Vg_{M1}$ of the driving transistor M1 is obtained by the following Equation 1:

$$Vg_{M1}=(Cdata*Vdata+Cst\cdot Vinit)/(Cdata+Cst) \quad \text{[Equation 1]}$$

Here, $Vg_{M1}$ is a gate voltage of the driving transistor M1, Vdata is a data voltage, Vinit is an initialization voltage, Vdd is a first power supply voltage, Cdata is a capacitor of each data line, and Cst is a storage capacitor of each pixel.

Referring to Equation 1, the gate voltage $Vg_{M1}$ of the driving transistor M1 differs from the data voltage Vdata according to the capacitances of the data line capacitor Cdata and the storage capacitor Cst in the pixel. That is, a lower voltage than the data voltage applied to the data line is actually applied to the gate electrode of the driving transistor. Therefore, it is difficult to properly represent a black gradation, thereby deteriorating a contrast ratio.

This problem can be solved by increasing the black data voltage. However, it is difficult or impossible to increase the back data voltage without changing a specification of the data driver. Alternatively, this problem can be solved by lowering the first power supply voltage Vdd. In this case, the black gradation can be properly represented if the second power supply voltage Vss is also lowered to as much as the voltage level of the first power supply voltage Vdd has been lowered. As such, a DC/DC efficiency of the power supply voltages Vdd and Vss may also be lowered.

According to an embodiment of the present invention, an auxiliary capacitor Caux is formed in a pixel as shown in FIG. 4.

That is, the pixel according to an embodiment of the present invention further includes an auxiliary capacitor Caux.

The auxiliary capacitor Caux has a first terminal connected in common to the current scan line Sn and the gate electrode of the first switching transistor M2, and a second terminal connected in common to the storage capacitor Cst and the gate electrode of the driving transistor M1.

The auxiliary capacitor Caux is employed to boost up the gate voltage $V_G$ of the driving transistor M1 during a change from a scan period to an emission period. Here, low and high level voltages of a scan signal are referred to as a low scan voltage (or signal) VVSS and a high scan voltage (or signal) VVDD, respectively. Thus, when a voltage applied to the first terminal of the auxiliary capacitor Caux changes from the low scan voltage VVSS to the high scan voltage VVDD, the gate voltage $V_G$ of the driving transistor M1 is boosted up to as much as a compensation voltage obtained by coupling the storage capacitor Cst to the auxiliary capacitor Caux.

The gate voltage $V_G$ of the driving transistor M1 can be obtained by the following Equation 2:

$$Cst\Delta V=Caux\Delta V$$

$$Cst\{(Vdd-Vg_{M1})-(Vdd-V_G)\}=Caux\{(Vg_{M1}-VVSS)-(V_G-VVDD)\}$$

$$V_G=Vg_{M1}+Caux*(VVDD-VVSS)/(Cst+Caux) \quad \text{[Equation 2]}$$

Here, VVDD is a high level scan voltage (or signal), VVSS is a low level scan voltage (or signal), $Vg_{M1}$ is a voltage applied to the gate electrode of the driving transistor M1 when the low level scan voltage (or signal) VVSS is applied, $V_G$ is a voltage applied to the gate electrode of the driving transistor M1 when the high level scan voltage (or signal) VVSS is applied, Caux is a capacitance of an auxiliary capacitor, and Cst is a capacitance of a storage capacitor.

Referring to Equation 2, as the auxiliary capacitor Caux is added to the pixel, the voltage applied to the gate electrode of the driving transistor M1 is increased to as much as a compensation voltage of Caux*(VVDD−VVSS)/(Cst+Caux), thereby compensating for the voltage difference. Therefore, a black current flow is substantially reduced while the black level gradation voltage is applied, thereby enhancing the contrast ratio. This is shown in the graph of FIG. 5.

Figure 5:
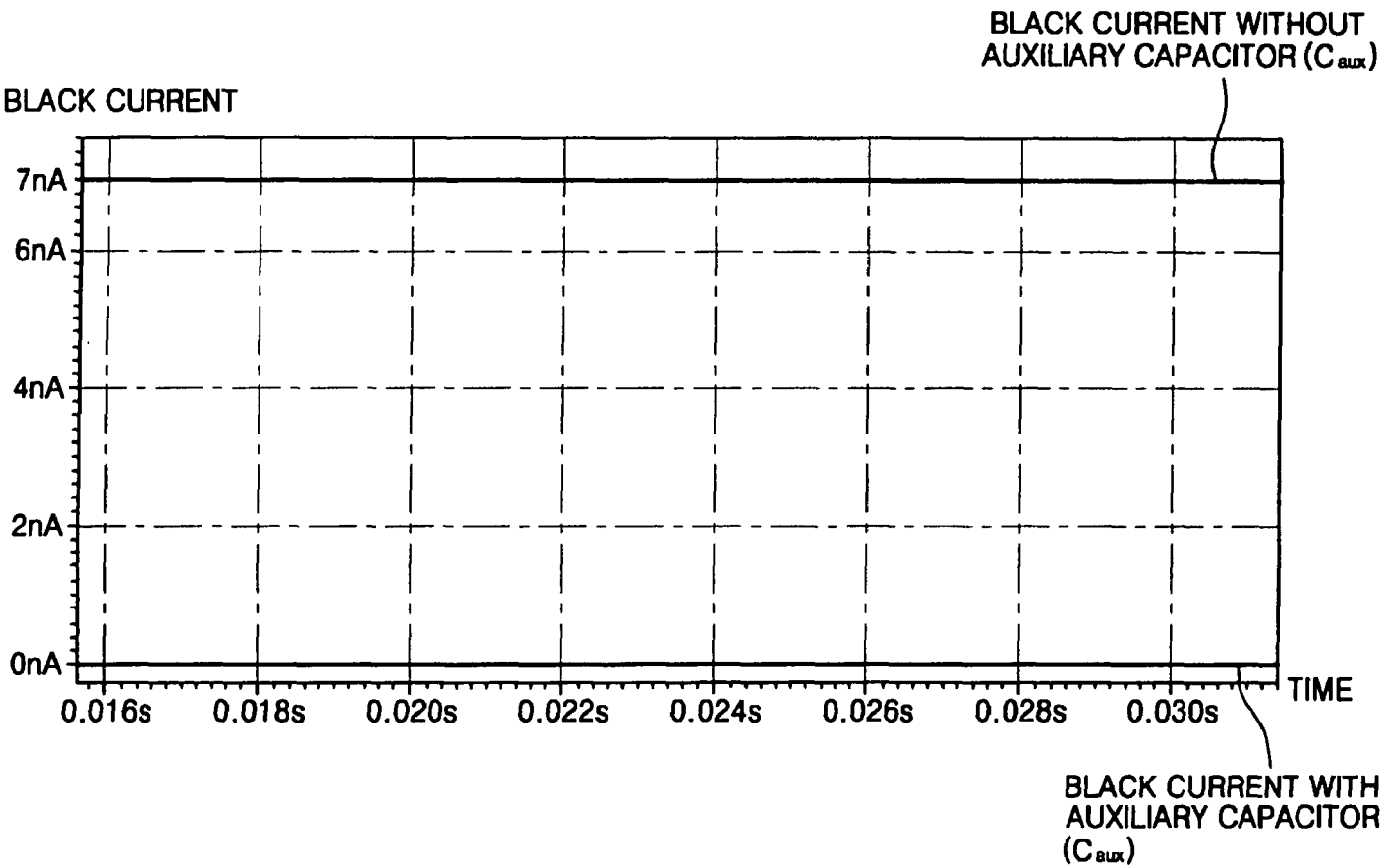
FIG. 5 is a graph of a simulation of black current flowing when a black gradation voltage is applied to the pixel of FIG. 4.

FIG. 5 is a graph of a simulation of black current flowing when a black gradation voltage is applied to the pixel of FIG. 4.

In FIG. 5, a first power supply voltage Vdd of 5[V], a second power supply voltage Vss of −6[V], and a data voltage Vdata of 5[V] are applied to the pixel shown in FIG. 4. Further, in FIG. 5, a vertical axis indicates the amount of black current, and a horizontal axis indicates time.

In the case that the first power supply voltage Vdd is equal to the black data voltage, a high black current of about 7 nA flows in the driving transistor M1 in the pixel without the auxiliary capacitor Caux, and thus the contrast ratio is very low. By contrast, a low black current of about 0.02 nA flows in the driving transistor M1 in the pixel with the auxiliary capacitor Caux according to an embodiment of the present invention, thereby satisfying the specification of 0.03 nA and enhancing the contrast ratio. Thus, the auxiliary capacitor Caux is formed in the pixel, so that the lowering of the data voltage applied to the pixel is prevented or substantially reduced. As such, in the pixel with the auxiliary capacitor Caux, it is not necessary to lower the first and second power supply voltages Vdd and Vss, thereby enhancing DC/DC efficiency.

Here, in one embodiment of the present invention, the capacitance of the storage capacitor Cst is larger than that of the auxiliary capacitor Caux. In FIG. 5, the capacitance of the storage capacitor Cst is larger than that of the auxiliary capacitor Caux by about ten times.

Figure 6:
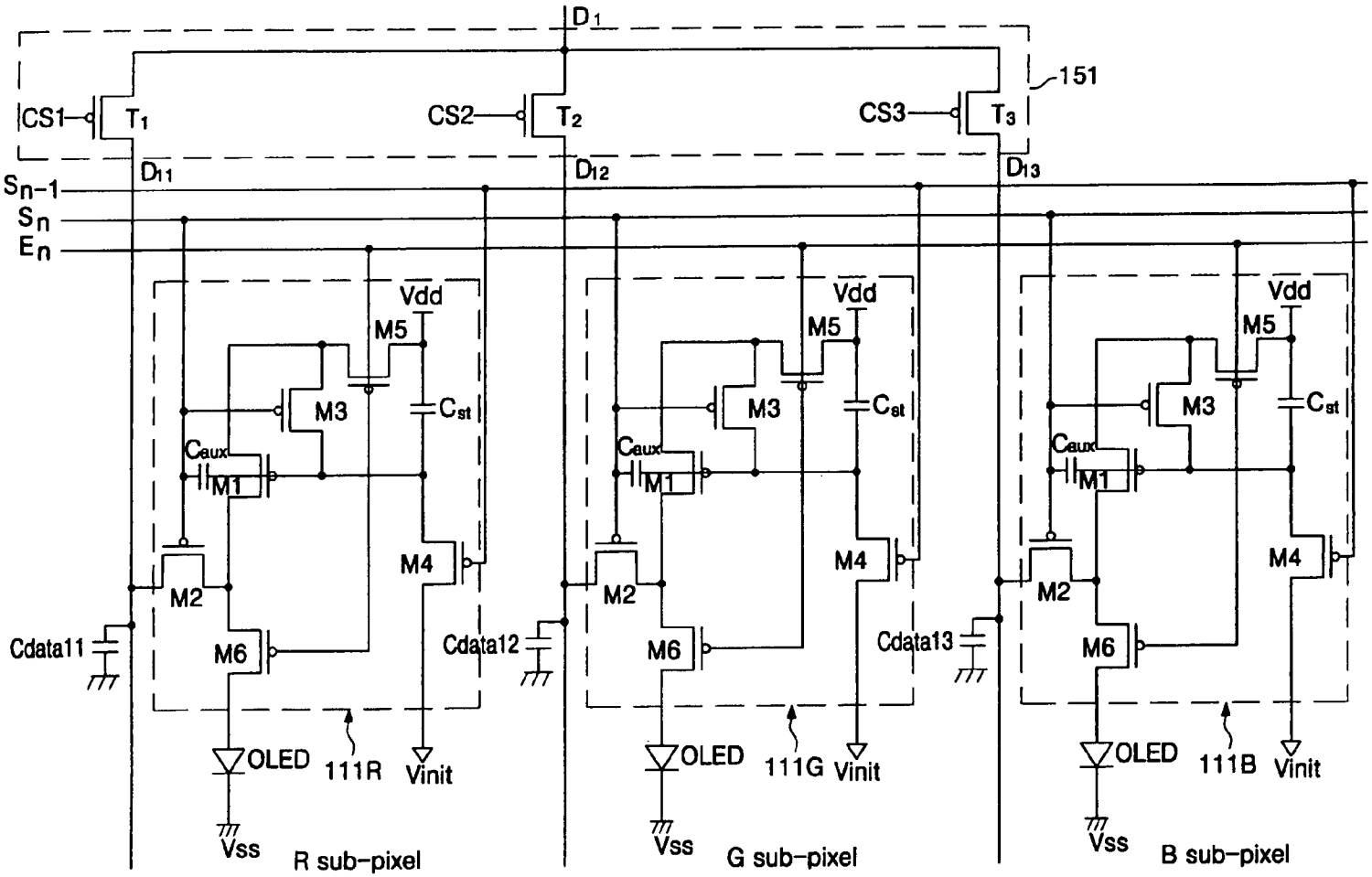
FIG. 6 is a circuit diagram illustrating a detailed connection structure between the demultiplexer of FIG. 3 and the pixel of FIG. 4 according to an embodiment of the present invention.

FIG. 6 is a circuit diagram illustrating a detailed connection structure between the demultiplexer of FIG. 3 and the pixel of FIG. 4 according to an embodiment of the present invention, and FIG. 7 is a timing diagram for driving a pixel circuit of FIG. 6. In FIG. 6, it is assumed that the demultiplexer 151 connected to the $1^{st}$ output line D1 is connected with R, G and B sub-pixels (i.e., k=3).

Referring to FIGS. 6 and 7, a low level scan signal is supplied to the $(n-1)^{th}$ scan line Sn−1 in the $(n-1)^{th}$ scan period of one horizontal period 1H. When the scan signal is supplied to the $(n-1)^{th}$ scan line Sn−1, each initialization transistor M4 of the R, G and B sub-pixels is turned on. As the initialization transistor M4 is turned on, the first terminal of the storage capacitor Cst and the gate electrode of the driving transistor M1 are connected to the initialization power supply line Vinit. That is, when the scan signal is supplied to the $(n-1)^{th}$ scan line Sn−1, the previous frame data voltage stored in each storage capacitor Cst of the R, G and B pixels, i.e., the gate voltage of the driving transistor M1, is initialized. Further, when the scan signal is supplied to the $(n-1)^{th}$ scan line Sn−1, the first switching transistor M2 connected to the $n^{th}$ scan line Sn is maintained in an off state.

Then, the first switching device T1, the second switching device T2, and the third switching device T3 are sequentially turned on by the first through third control signals CS1, CS2 and CS3 sequentially supplied in the data programming period. When the first switching device T1 is turned on by the first control signal CS1, the R data signal is supplied from the $1^{st}$ output line D1 to the $1^{st}$ data line D11. At this time, the $1^{st}$ data line capacitor $C_{data11}$ is charged with a voltage corresponding to the R data signal supplied to the $1^{st}$ data line D11. Then, when the second switching device T2 is turned on by the $2^{nd}$ control signal CS2, the G data signal is supplied from the $1^{st}$ output line D1 to the $2^{nd}$ data line D12. At this time, the $2^{nd}$ data line capacitor $C_{data12}$ is charged with a voltage corresponding to the G data signal supplied to the $2^{nd}$ data line D12. Last, when the third switching device T3 is turned on by the $3^{rd}$ control signal CS3, the B data signal is supplied from the $1^{st}$ output line D1 to the $3^{rd}$ data line D13. At this time, the $3^{rd}$ data line capacitor $C_{data13}$ is charged with a voltage corresponding to the B data signal supplied to the $3^{rd}$ data line D13. In addition, the scan signal is not supplied to the $n^{th}$ scan line Sn in the data programming period, so that the R, G and B data signals are not supplied to the R, G and B pixels, respectively.

Then, a low level scan signal is supplied to the $n^{th}$ scan line Sn in the $n^{th}$ scan period following the data programming period. When the scan signal is supplied to the $n^{th}$ scan line Sn, each first switching transistor M2 and each threshold voltage compensation transistor M3 provided in the R, G and B pixels are turned on. Each first switching transistor M2 of the R, G and B pixels transmits a voltage Vdata corresponding to each of the R, G and B data signals, which is stored in the $1^{st}$ through $3^{rd}$ data line capacitors $C_{data11}$ through $C_{data13}$ in the data programming period, to the respective R, G and B pixels. Here, the threshold voltage compensation transistor M3 connects the driving transistor M1 to function like a diode. That is, a voltage $Vdata-Vth_{M1}$[V] corresponding to a difference between the voltage Vdata corresponding to each of the R, G and B data signals stored in the $1^{st}$ through $3^{rd}$ data line capacitors $C_{data11}$ through $C_{data13}$ and the threshold voltage Vth of the corresponding driving transistor M1 is applied to both the gate electrode of the driving transistor M1 and the first terminal of the storage capacitor Cst through the driving transistor M1 connected to function like a diode. Here, the voltage applied to the gate electrode of the driving transistor M1 is equal to the value obtained by Equation 1.

Then, in each of the R, G and B pixels, when the $n^{th}$ scan signal is changed to a high level and a low level emission control signal is applied to the emission control line En, the second switching transistor M5 and the emission control transistor M6 are turned on, so that the first power supply Vdd applied to the source electrode of the driving transistor M1 and the driving current corresponding to the voltage applied to the gate electrode thereof are supplied to the organic light emitting diode OLED through the emission control transistor M6, thereby emitting light with a certain (or predetermined) brightness. Here, the voltage applied to the gate electrode of the driving transistor M1 is equal to the value obtained by Equation 2.

Thus, the organic electroluminescent display device according to an embodiment of the present invention employs the demultiplexer 151 to sequentially supply R, G and B data signals from the $1^{st}$ output line D1 to k data lines D11-D1*k*. Further, voltages corresponding to the data signals are stored in the data line capacitors $C_{data11}$-$C_{data1k}$ in the data programming period, and the voltages stored in the data line capacitors $C_{data11}$-$C_{data1k}$ are supplied to the pixels in the scan period. Thus, the voltages stored in the data line capacitors $C_{data11}$-$C_{data1k}$ are supplied to the respective pixels at the same time, i.e., the data signals are supplied at the same time, thereby displaying an image with uniform brightness.

Also, the auxiliary capacitor Caux is formed in each pixel, so that an electric charge is shared between the data line capacitor Cdata and the storage capacitor Cst, thereby substantially lowering the voltage applied to the pixel, and enhancing the contrast ratio. Thus, the DC/DC efficiency is maintained without lowering the power supply voltages Vdd and Vss.

As described above, an embodiment of the present invention provides an organic electroluminescent display device in which an auxiliary capacitor Caux is formed in a pixel so that a data voltage applied to the pixel by a demultiplexer is compensated, thereby representing a black gradation and enhancing a contrast ratio.

Thus, it is not needed to lower power supply voltages Vdd and Vss to compensate for a lowered data voltage, thereby enhancing a DC/DC efficiency of a power supply.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An organic electroluminescent display device comprising:

a display region having a plurality of pixels formed at regions where a plurality of scan lines and a plurality of data lines cross, the pixels coupled to a first power supply voltage line and a second power supply voltage line to display an image thereon;

a scan driver for supplying scan signals to the plurality of scan lines and for selecting the plurality of pixels;

a plurality of demultiplexers for sequentially supplying data voltages to the plurality of data lines; and a data driver for supplying the data voltages to a plurality of output lines connected to the respective demultiplexers;

wherein each of the pixels comprises:

a storage capacitor for storing at least one of the data voltages from at least one of the data lines in response to a first one of the scan signals supplied from a first scan line;

an auxiliary capacitor connected to the storage capacitor and directly connected to the first scan line, and for generating a compensation voltage to increase the at least one of the data voltages according to a level change of the first one of the scan signals;

an initialization transistor having a first electrode connected to a first terminal of the storage capacitor and a second electrode directly connected to an initialization power supply line that is separated from the first power supply voltage line and the second power supply voltage line, and being adapted to turn on by a second one of the scan signals, supplied from a second scan line, to initialize the storage capacitor;

a first switching transistor connected to the data line and being adapted to turn on by the first one of the scan signals to transmit the at least one of the data voltages;

a driving transistor having a first electrode directly connected to the first switching transistor, a second electrode, and a gate electrode connected to the first terminal of the storage capacitor to generate a driving current; and a second switching transistor directly connected between the first power supply voltage line and the second electrode of the driving transistor, and being adapted to turn on by an emission control signal to supply a first power supply voltage from the first power supply voltage line to the second electrode of the driving transistor;

wherein the storage capacitor has a capacitance larger than that of the auxiliary capacitor.

2. The organic electroluminescent display device as claimed in claim 1, wherein the compensation voltage generated by the auxiliary capacitor is determined by:

$$Vx=Caux*(VVDD-VVSS)/(Cst+Caux),$$

wherein, Vx is the compensation voltage, Caux is a capacitance of the auxiliary capacitor, Cst is a capacitance of the storage capacitor, VVDD is a high level scan voltage of the first one of the scan signals, and VVSS is a low level scan voltage of the first one of the scan signals.

3. The organic electroluminescent display device as claimed in claim 2, wherein each of the pixels further comprises:

a threshold voltage compensation transistor connected between the gate electrode and the second electrode of the driving transistor, being adapted to turn on by the first one of the scan signals to electrically connect the gate electrode and the second electrode of the driving transistor, and being adapted to compensate for the threshold voltage of the driving transistor; and an organic light emitting diode connected between the driving transistor and the second power supply voltage line to emit light with a brightness according to an amount of the driving current.

4. The organic electroluminescent display device as claimed in claim 3, wherein each of the pixels further comprises an emission control transistor connected between the driving transistor and the organic light emitting diode, and being adapted to turn on or off by the emission control signal to control a supply of the driving current to the organic light emitting diode.

5. The organic electroluminescent display device as claimed in claim 4, wherein the initialization transistor, the first switching transistor, the driving transistor, the threshold voltage compensation transistor, the second switching transistor, and the emission control transistor formed in each of the pixels are of a same conductivity type.

6. The organic electroluminescent display device as claimed in claim 3, wherein the second one of the scan signals is an (n−1)th scan signal, and the first one of the scan signals is an nth scan signal, where n is an integer greater than or equal to 2.

7. The organic electroluminescent display device as claimed in claim 6, wherein the emission control signal is an $n^{th}$ emission control signal.

8. The organic electroluminescent display device as claimed in claim 3, wherein the threshold voltage compensation transistor is turned on to connect the driving transistor to function like a diode.

9. The organic electroluminescent display device as claimed in claim 1, wherein the data lines are larger in number than the output lines.

10. The organic electroluminescent display device as claimed in claim 1, wherein the storage capacitor has a capacitance that is about ten times larger than that of the auxiliary capacitor.

11. An organic electroluminescent display device comprising a plurality of pixels formed at regions where a plurality of scan lines and a plurality of data lines cross, each of the pixels coupled to a first power supply voltage line and a second power supply voltage line and comprising:

a pixel driving circuit comprising:

a storage capacitor for storing a data voltage from at least one of the data lines in response to a first scan signal of a first scan line;

an auxiliary capacitor connected to the storage capacitor and directly connected to the first scan line to generate a compensation voltage for increasing the data voltage according to a level change of the first scan signal;

an initialization transistor having a first electrode connected to a first terminal of the storage capacitor and a second electrode directly connected to an initialization power supply line that is separated from the first power supply voltage line and the second power supply voltage line, and being adapted to turn on by a second scan signal, supplied from a second scan line, to initialize the storage capacitor;

a first switching transistor connected to the data line and being adapted to turn on by the first scan signal, supplied from the first scan line, to transmit the data voltage;

a driving transistor having a first electrode directly connected to the first switching transistor, a second electrode, and a gate electrode connected to the first terminal of the storage capacitor to generate a driving current; and a second switching transistor directly connected between the first power supply voltage line and the second electrode of the driving transistor, and being adapted to turn on by an emission control signal to supply a first power supply voltage from the first power supply voltage line to the second electrode of the driving transistor;

the pixel driving circuit being adapted to output the driving current; and an organic light emitting diode connected to the pixel driving circuit to emit light with a brightness according to an amount of the driving current;

wherein the storage capacitor has a capacitance larger than that of the auxiliary capacitor.

12. The organic electroluminescent display device as claimed in claim 11, wherein the compensation voltage generated by the auxiliary capacitor is determined by:

$$Vx=Caux*(VVDD-VVSS)/(Cst+Caux)$$

wherein, Vx is the compensation voltage, Caux is a capacitance of the auxiliary capacitor, Cst is a capacitance of the storage capacitor, VVDD is a high level scan voltage of the first scan signal, and VVSS is a low level scan voltage of the first scan signal.

13. The organic electroluminescent display device as claimed in claim 12, wherein the pixel driving circuit further comprises a threshold voltage compensation transistor connected between the gate electrode and the second electrode of the driving transistor, being adapted to turn on by the first scan signal to electrically connect the gate electrode and the second electrode of the driving transistor, and being adapted to compensate for the threshold voltage of the driving transistor.

14. The organic electroluminescent display device as claimed in claim 13, wherein the pixel driving circuit further comprises an emission control transistor connected between the driving transistor and the organic light emitting diode, and being adapted to turn on or off by the emission control signal to control the supply of the driving current to the organic light emitting diode.

15. The organic electroluminescent display device as claimed in claim 14, wherein the initialization transistor, the first switching transistor, the driving transistor, the threshold voltage compensation transistor, the second switching transistor, and the emission control transistor are of a same conductivity type.

16. The organic electroluminescent display device as claimed in claim 13, wherein the second scan signal is an (n−1)th scan signal, and the first scan signal is an nth scan signal, where n is an integer greater than or equal to 2.

17. The organic electroluminescent display device as claimed in claim 16, wherein the emission control signal is an $n^{th}$ emission control signal.

18. The organic electroluminescent display device as claimed in claim 13, wherein the threshold voltage compensation transistor is turned on to connect the driving transistor to function like a diode.

19. The organic electroluminescent display device as claimed in claim 11, wherein the data lines are larger in number than the output lines.

20. The organic electroluminescent display device as claimed in claim 11, wherein the storage capacitor has a capacitance that is about ten times larger than that of the auxiliary capacitor.

* * * * *